United States Patent [19]

Call

[11] Patent Number: 4,849,720

[45] Date of Patent: Jul. 18, 1989

[54] ORTHOGONAL MODE TEE

[75] Inventor: William F. Call, Bellingham, Mass.

[73] Assignee: Neico Microwave Company, Hopkinton, MA

[21] Appl. No.: 866,322

[22] Filed: May 22, 1986

Related U.S. Application Data

[63] Continuation-in-part of Ser. No. 783,213, Oct. 2, 1985, abandoned.

[51] Int. Cl.[4] ..... H01P 1/161

[52] U.S. Cl. ..... 333/125; 333/137; 333/21 A

[58] Field of Search ..... 333/122, 121, 117, 123, 333/125, 136, 137, 21 A

[56] References Cited

U.S. PATENT DOCUMENTS

| | | | |
|---|---|---|---|
| 2,628,036 | 6/1954 | Dicke | 333/122 |
| 2,704,351 | 3/1955 | Dicke | 333/122 |
| 2,973,486 | 2/1981 | Salzberg | 333/125 X |
| 2,806,210 | 9/1957 | Edwards | 333/122 |
| 3,932,822 | 1/1976 | Salzberg | 333/117 X |
| 4,119,967 | 10/1978 | Johnson et al. | 333/21 A |
| 4,366,453 | 12/1982 | Schwarz | 333/117 |

OTHER PUBLICATIONS

Pound, R. V.; Abstract of U.S. Patent Application Ser. No. 648525, published Feb. 20, 1951, O.G., vol. 643, p. 1020.

*Primary Examiner*—Eugene R. LaRoche
*Assistant Examiner*—Benny Lee
*Attorney, Agent, or Firm*—Donald Brown

[57] ABSTRACT

An orthogonal mode tee to use at microwave frequencies and having a junction for three ports, two of the ports propagating the $TE_{10}$ mode and the common port propagating the $TE_{11}$ mode.

5 Claims, 5 Drawing Sheets

ORTHOGONAL MODE TEE

PRIOR APPLICATION

This application is a continuation-in-part of U.S. patent application Ser. No. 783,213, filed Oct. 2, 1985, now abandoned.

BACKGROUND OF THE DISCLOSURE

Orthogonal Mode Tees also known as dual mode transducers or orthognal mode junctions have long been used in microwave communications applications.

Orthogonal mode tees have the unique property of being able to separate orthogonally polarized microwave signals (e.g., horizontal from vertical). Thus, these devices are currently used in such commercial applications as satellites where two isolated channels can be used at the same frequency.

Various devices of this type have appeared in the prior art for use at various frequencies. However, there has been difficulty in constructing a high power device which will function effectively and efficiently at high frequencies, e.g., $GH_z$ frequencies, e.g., 5 to 50 $GH_z$.

The present invention provides a new and improved tee structure which is useful at the higher frequencies and which is capable of handling high power. The device of this invention finds use in applications in which two separate transmitters providing orthogonally polarized signals can simultaneously transmit through a common antenna and in other applications as would be apparent to those skilled in the art.

The prior art which shows other types of orthogonal mode junctions and uses of same see, e.g., U.S. Pat. No. 3,932,822 and the article entitled "The Ortho-Mode Transducer Offers a K to Polarization Diversity in EW Systems in Microwave Systems", NEWS (MSN), September, 1984, pp. 65–70.

SUMMARY OF THE INVENTION

The orthomode junction of this invention is useful at $GH_z$frequencies to provide two orthogonal signals to a single device. The junction of this invention is a three port device normally referred to as the E port, the H port and the common port. Each of the input ports are rectangular waveguide sections constructed to support only a single-voltage vector of a linear polarized wave in the TE10 fundamental mode. The third port is termed the common port and is substantially of a square waveguide configuration. Since the device of this invention is reciprocal, the tee device can also be used to separate two orthogonal components when used in the reverse direction, i.e., by feeding the common port with two orthogonally polarized signals.

The improved junction tee of this invention uses an extension of the broad wall of one of the input ports slightly beyond center of the common port and slightly beyond the junction region into the other input port along with matching means to accomplish the desired result.

All dimensions given in the Figures is in inches with a tolerance of 0.002 being satisfactory at 14 $GH_z$, a tolerance of $\pm 0.001$ being satisfactory at 44 $GH_z$ and a tolerance of $\pm 0.003$ being satisfactory at about 9 $GH_z$.

DETAILED DESCRIPTION OF THE PREFERRED EMBODIMENTS

Figure 1:
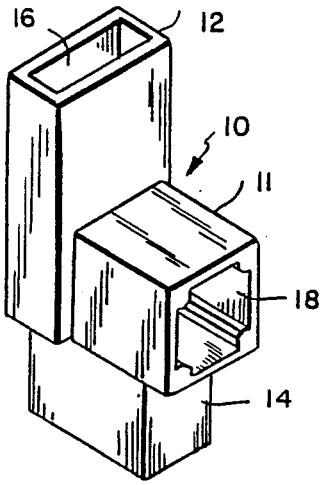
FIG. 1 is a perspective view of the orthomode junction of this invention which is to operate at frequency between 14 to 14.5 $GH_z$.
Figure 2:
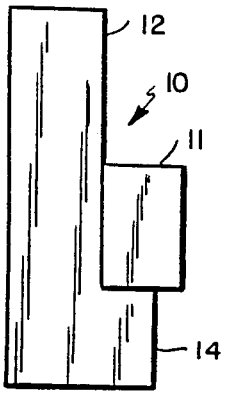
FIG. 2 is a side view of the junction of this invention shown in FIG. 1.
Figure 3:
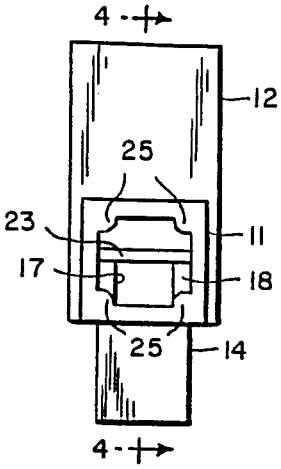
FIG. 3 is a front view of the junction of this invention shown in FIG. 1.
Figure 5:
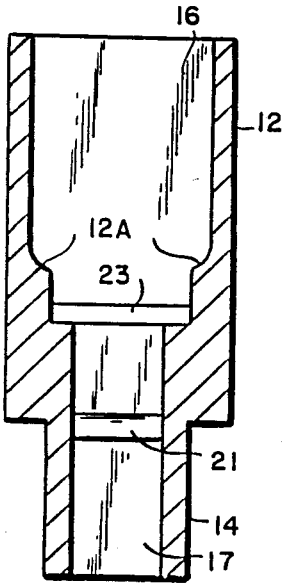
FIG. 5 is a sectional view taken along line 5—5 of FIG. 4.
Figure 4:
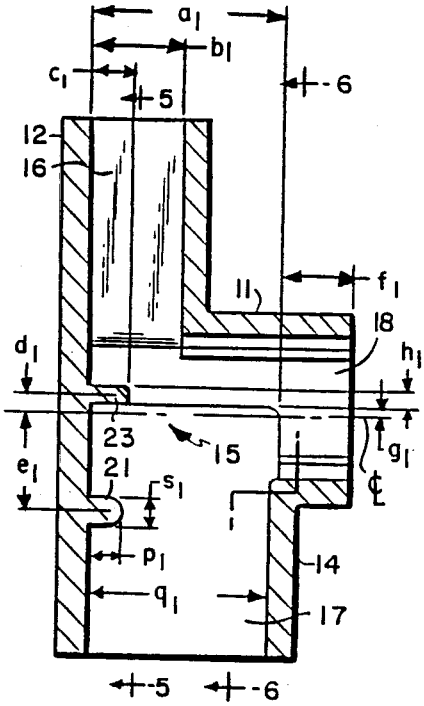
FIG. 4 is a sectional view taken along line 4—4 of FIG. 3 shown in FIG. 1.
Figure 6:
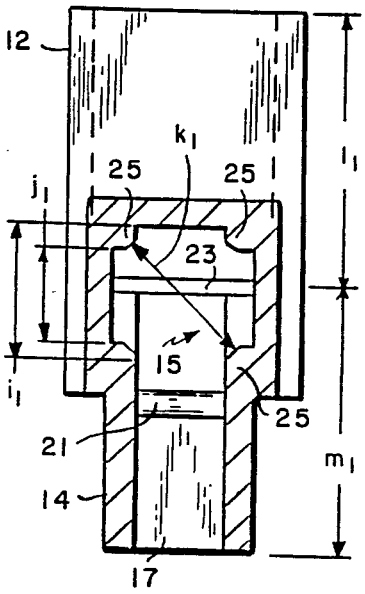
FIG. 6 is a sectional view taken along line 6—6 of FIG. 4.
Figure 7:
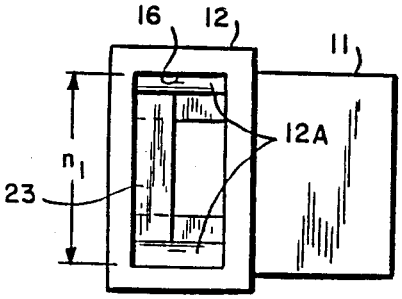
FIG. 7 is a top view looking down at FIG. 2.
Figure 8:
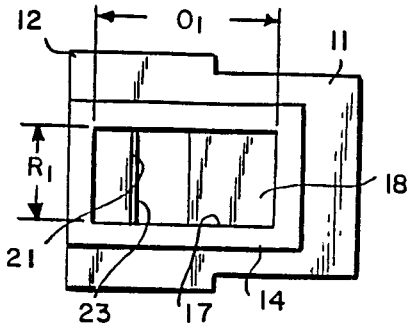
FIG. 8 is a bottom view looking up at FIG. 2.
Figure 9:
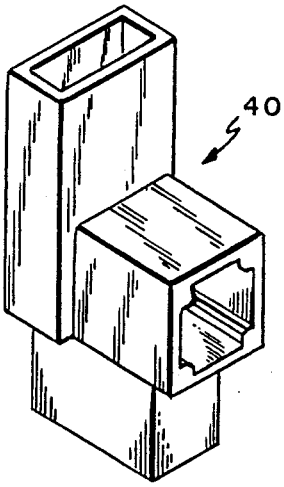
FIG. 9 is a perspective view of the orthomode junction of this invention which is designed to operate at frequencies between 43.5 to 44.5 $GH_z$.
Figure 10:
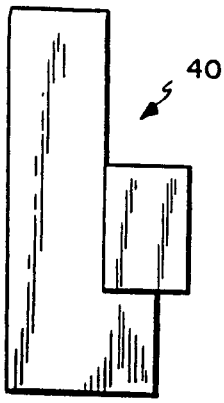
FIG. 10 is a side view of the junction of this invention shown in FIG. 9.
Figure 11:
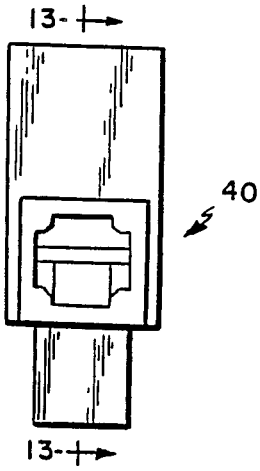
FIG. 11 is a front view of the junction of this invention shown in FIG. 9.
Figure 12:
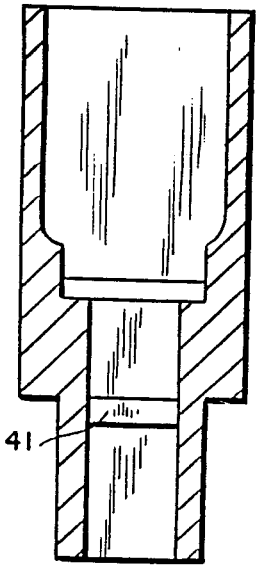
FIG. 12 is a sectional view taken along line 12—12 of FIG. 13.
Figure 13:
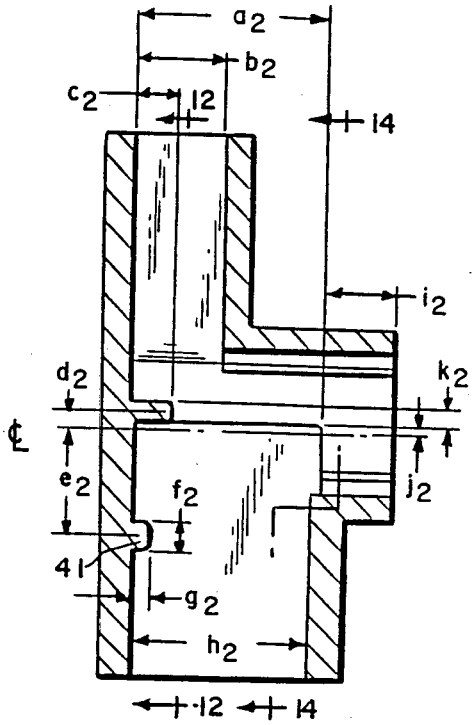
FIG. 13 is a sectional view taken along line 13—13 of FIG. 11.
Figure 14:
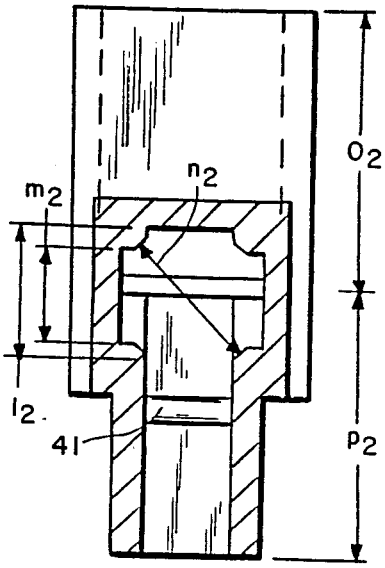
FIG. 14 is a sectional view taken along line 14—14 of FIG. 13.
Figure 15:
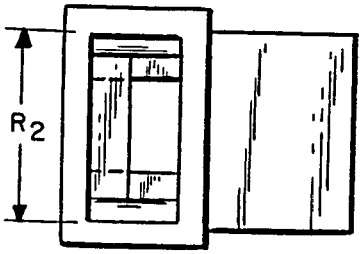
FIG. 15 is a top view looking down at FIG. 10.
Figure 16:
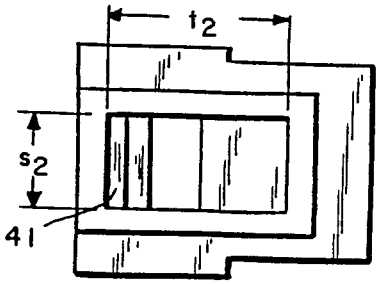
FIG. 16 is a bottom view looking up at FIG. 10.

The orthogonal mode tee is shown at 10 in FIG. 1. This tee is designed to function at 14 to 14.5 $GH_z$and is shown in more detail in FIGS. 2 to 16. The tee comprises a common waveguide arm 11 having an output port 18, an E-arm 12 having a input port 16 and an H-arm 14 having an input port 17. Power is fed into ports 16 and 17 of the waveguide arms 12 and 14 and exits from port 18 when it is used to combine orthognal signals from two separate sources, e.g., transmitters. The waveguide arm 12 is provided with a narrowing portions 12A. A junction region for the tee is shown at 15 (see FIGS. 4 and 6) and the portions in the junction region contribute to the performance of the device. A shelf protrusion is shown at 23 (see FIGS. 3 to 8) in the junction region acts essentially as a capacitive iris to provide a major contribution to the matching of arm 12 and port 16. Extension of the broader (larger) inner walls of arm 14 slightly beyond center of arm 11 and slightly into arm 11 creates a structure along with shelf protrusion 21 (see FIGS. 4, 5, 6 and 8) to provide matching for the arm 14. Corner fillets 24 (see FIGS. 3 and 6) are provided in the interior of the common arm 11 to provide suppression of the higher order modes and matching to arm 11 since the TE11 is the mode which is to be propagated. The device of the FIGS. 1 to 8 are dimensioned for the particular frequency with all dimensions in inches. Ports 16, 17 and 18 may be fitted directly to waveguides or other mating components or may terminate in flanges (not shown) for choke or similar coupling to mating components. Reference should now be had to FIGS. 9 to 16 which shows a tee useful at a frequency of 43.5 to 45.5 $GH_z$. In this construction, the tee 40 is slightly modified at protrusion 41 because of the smaller dimensions at this frequency a small radius is provided on the protrusion 41. However, functionally the tee of FIGS. 9 to 16 operate the same as the tee of FIGS. 1 to 8. The dimensions are again given in inches and the tee is adapted to carry high power.

Figure 17:
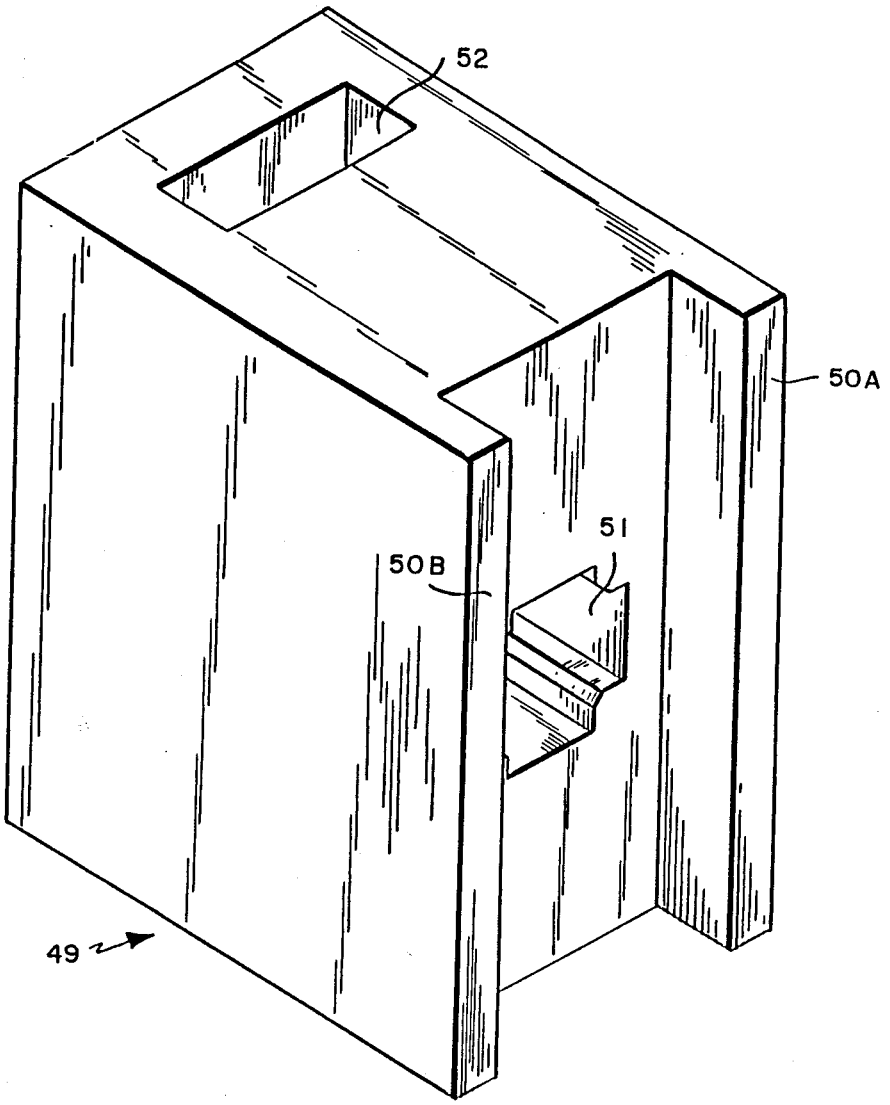
FIG. 17 is a modified device according to FIG. 9 in a form suitable for connection to external devices.
Figure 18:
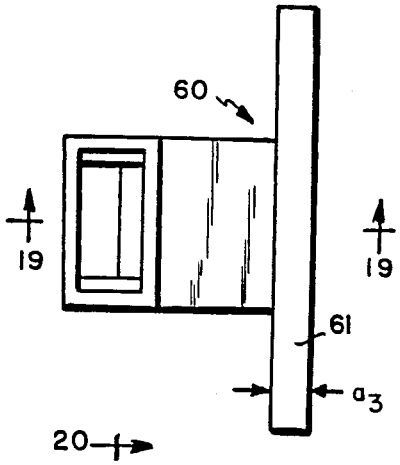
FIG. 18 is a top plan view of an orthomode junction of this invention which is designed to operate at frequencies between 8.68 and 10.8 $GH_z$.
Figure 19:
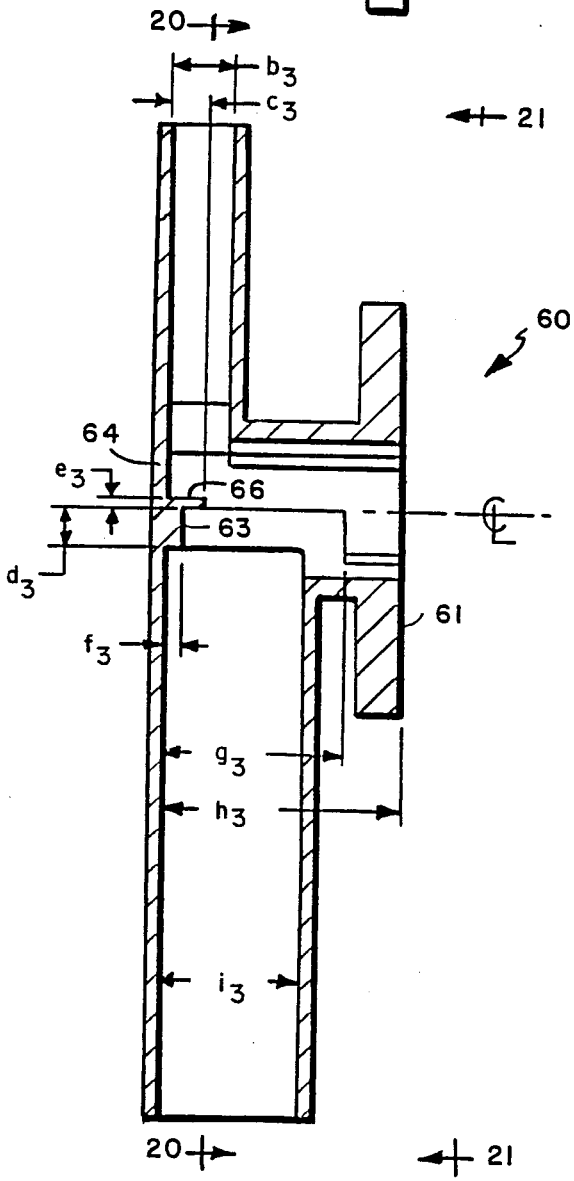
FIG. 19 is a sectional view taken along line 19—19 of FIG. 18.
Figure 20:
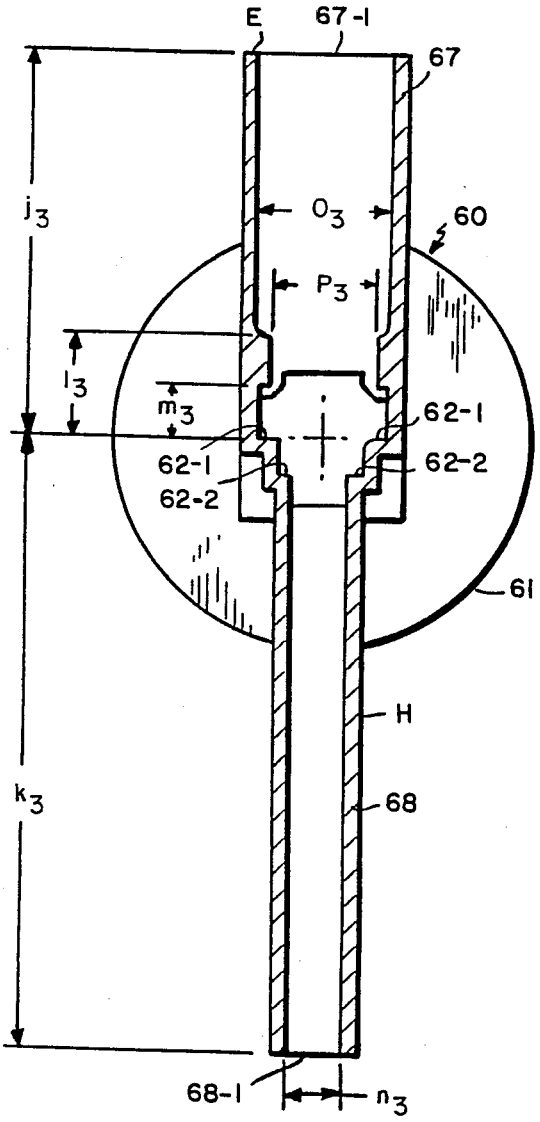
FIG. 20 is a sectional view taken along line 20—20 of FIG. 19.
Figure 21:
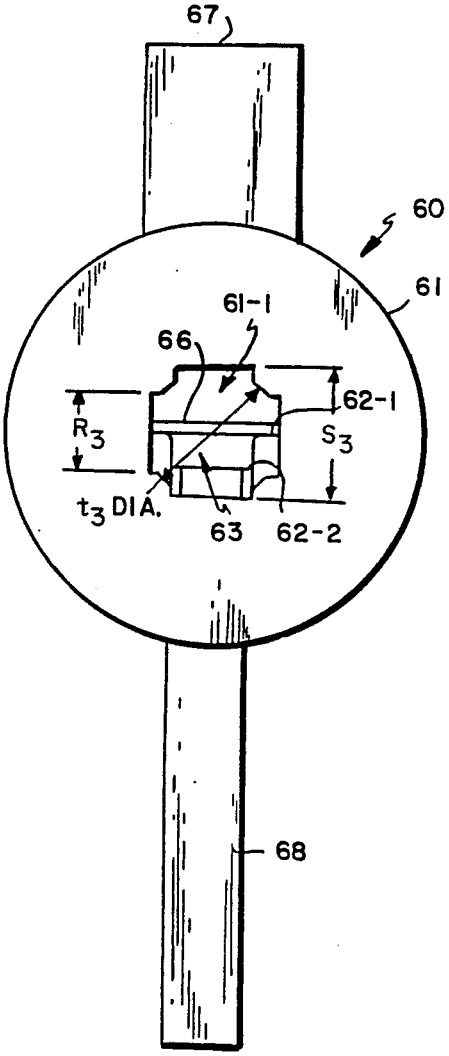
FIG. 21 is a front view taken along line 21—21 of FIG. 19.

FIG. 17 shows a configuration of a cast tee 49, e.g., of beryllium where legs 50A and 50B are provided to permitted connection to external devices. The common port for the device of FIG. 17 is shown at 51. The E port is shown at 52 and the H port would be opposite thereto at the bottom of the device. The internal tee configuration would be the same as shown in FIGS. 1 to 16.

Reference should now be had to FIGS. 18 to 21 for a description of the embodiment of the invention particularly suitable for operation at a frequency of about 8.6 to 10.8 $GH_z$. In this construction, the junction device 60 has a common arm with a round plate like connecting portion 61 (see FIGS. 18 and 19) and a port 61-1 (see FIGS. 20 and 21. The common portion has step like shelves 62-1 and 62-2 (see FIGS. 20 and 21) on either side at the bottom with the shelf portions 62-1 extending into the junction where they meet a wall portion 63 (see FIGS. 19 and 21) which extends from the back wall 64 (see FIG. 19). A shelf protrusion 66 (see FIGS. 19 and 21) is also provided. The combination of the wall portion 63 and shelf protrusion 66 act to provide impedance matching. The E-arm of the device is shown at 67 (see FIGS. 20 and 21) having a port 67-1 and the H-arm of the device is shown at 68 (see FIGS. 20 and 21) having a port 68-1.

Accordingly, this invention provides an orthogonal mode tee which has an E-arm of a rectangular waveguide section having two inner broad walls and two narrow inner walls and a port, and H-arm of a rectangular waveguide section having two inner broad walls and two narrow inner walls and a port, and a common arm of substantially a square waveguide section having interior walls and a having a port, said E-arm being the arm which has a broad interior wall meeting an interior wall of the common arm at a right angle and said H-arm being the arm having a narrow interior wall meeting said interior wall of the common arm at right angles, said interior walls of said arms coming together at a junction region, said H-arm having a shelf protrusion partially extending into the interior of the waveguide from one narrow wall thereof and extending between the broad walls thereof; said broad walls of said H-arm extending a small distance beyond the center of common arm and slightly beyond junction region into the common arm, and a shelf protrusion in said junction region and partially extending from one broad wall of said E-arm into junction region.

The input frequency signals to the E and H arms would be in the same frequency range; however, the E vector of the signal to H port would be at right angles to the E vector provided to the E port.

In FIGS. 4, 6, 7 and 8, the dimensions for the device of these figures are as follows: $a_1=0.792$ inches; $b_1=0.375$ inches; $c_1=0.187$ inches; $d_1=0.039$ inches; $e_1=0.576$ inches; $f_1=0.276$ inches; $g_1=0.014$ inches; $h_1=0.050$ inches; $i_1=0.593$ inches; $j_1=0.375$ inches; $k_1=0.593$ inches; $l_1=2.0$ inches; $m_1=2.0$ inches; $n_1=0.750$ inches; $o_1=1.068$ inches; $p_1=0.125$ inches; $q_1=0.750$ inches and $r_1=0.375$ inches; $s_1=0.125$ inches.

In FIGS. 13 to 16, the dimensions for the device of these figures are as follows: $a_2=0.242$ inches; $b_2=0.112$ inches; $c_2=0.065$ inches; $d_2=0.0125$ inches; $e_2=0.157$ inches; $f_2=0.085$ inches; $g_2=0.036$ inches; $h_2=0.224$ inches; $i_2=0.086$ inches; $j_2=0.005$ inches; $k_2=0.015$ inches; $l_2==0.198$ inches; $m_2=0.128$ inches; $n_2=0.198$ inches; $o_2=0.6375$ inches; $p_2=0.6375$ inches; $r_2=0.224$ inches; $s_2=0.112$ and $t_2=0.328$ inches.

In FIGS. 18 to 21, the dimensions for the device of these figures are as follows: $a_3=0.310$ inches; $b_3=0.400$ inches; $c_3=0.230$ inches; $d_3=0.230$ inches; $e_3=0.050$ inches; $f_3=0.100$ inches; $g_3=1.180$ inches; $h_3=1.600$ inches; $i_3=0.900$ inches; $j_3=2.00$ inches; $k_3=4.000$ inches; inches; $m_3=0.335$ inches; $n_3=0.400$ inches; $o_3=0.900$ inches; $p_3=0.720$ inches; $r_3=0.540$ inches; $s_3=0.860$ and $t_3=0.860$ inches.

I claim:

1. An orthogonal mode tee consisting of three ports and having:

an E-arm of a rectangular waveguide section having two inner broad walls and two narrow inner walls and a first port of said three ports;

an H-arm of a rectangular waveguide section having two inner broad walls and two narrow inner walls and a second port of said three ports, the waveguide sections of the E and H arms being mutually perpendicular to each other;

and a common arm of substantially a square waveguide section having interior walls and having a third port of said three ports, said E-arm has a broad interior wall coupled to an interior wall of the common arm to form a right angle configuration and said H-arm having a narrow interior wall coupled to a different interior wall of the common arm to form a right angle configuration, said interior walls of said arms coming together at a junction region, said H-arm having a shelf protrusion partially extending into the interior of the waveguide from one narrow wall thereof and extending between the broad walls thereof; said broad walls of said H-arm extending beyond the junction region into the common arm, and shelf protrusion in said junction region partially extending from one broad wall of said E-arm into junction region and extending between the narrow walls of the E-arm.

2. The tee of claim 1 in which said common arm has interior corner fillets.

3. The tee of claim 1 in which the broad and narrow walls of the E and H arms are of substantially the same dimensions and the common arm walls are of a dimension narrower than the dimension of the largest dimension of the broad walls of said E and H arms.

4. An orthogonal mode tee consisting of three ports and having:

an E-arm of a rectangular waveguide section having two inner broad walls and two narrow inner walls and a first port of said three ports;

an H-arm of a rectangular waveguide section having two inner broad walls and two narrow inner walls and a second port of said three ports, the waveguide sections of the E and H arms being mutually perpendicular to each other;

and a common arm of substantially a square waveguide section having interior walls and having a third port of said three ports, said E-arm being the arm which has a broad interior wall coupled to an interior wall of the common arm to form a right angle configuration and said H-arm being the arm having a narrow interior wall coupled to a different interior wall of the common arm to form a right angle configuration, said interior walls of said arms coming together at a junction region, said broad walls of said H-arm extending into the common arm and into the junction region, and a shelf protrusion in said junction region and partially extending from one broad wall of said E-arm into junction region and extending between the narrow walls of said E-arm.

5. The tee of claim 4 in which the broad and narrow walls of the E and H arms are of substantially the same dimensions.

* * * * *